US010190197B2

(12) United States Patent
Baker et al.

(10) Patent No.: US 10,190,197 B2
(45) Date of Patent: Jan. 29, 2019

(54) OXIDATION RESISTANT HIGH-ENTROPY ALLOYS

(71) Applicant: The Trustees of Dartmouth College, Hanover, NH (US)

(72) Inventors: Ian Baker, Etna, NH (US); Zhangwei Wang, West Lebanon, NH (US)

(73) Assignee: THE TRUSTEES OF DARTMOUTH COLLEGE, Hanover, NH (US)

( * ) Notice: Subject to any disclaimer, the term of this patent is extended or adjusted under 35 U.S.C. 154(b) by 84 days.

(21) Appl. No.: 15/374,322

(22) Filed: Dec. 9, 2016

(65) Prior Publication Data

US 2017/0167003 A1 Jun. 15, 2017

Related U.S. Application Data

(60) Provisional application No. 62/266,414, filed on Dec. 11, 2015.

(51) Int. Cl.

| | |
|---|---|
| ***C22C 30/00*** | (2006.01) |
| ***C22C 38/40*** | (2006.01) |
| ***C22C 38/06*** | (2006.01) |
| ***C22C 38/04*** | (2006.01) |
| *H01F 1/01* | (2006.01) |

(52) U.S. Cl.

CPC ..... *C22C 30/00* (2013.01); *C22C 38/04* (2013.01); *C22C 38/06* (2013.01); *C22C 38/40* (2013.01); *H01F 1/012* (2013.01)

(58) Field of Classification Search

CPC ..... H01F 1/012; C22C 30/00; C22C 38/00; C22C 38/04; C22C 38/06; C22C 38/08; C22C 38/18; C22C 38/36; C22C 38/38; C22C 38/40; C22C 38/56; C22C 38/58; C22C 35/00; C22C 37/00; C22C 37/06; C22C 37/08; C22C 37/10

See application file for complete search history.

(56) References Cited

PUBLICATIONS

Allain et al. (2004) "A physical model of the twinning-induced plasticity effect in a high manganese austenitic steel," Mater. Sci. Eng. A. 387-389:143-147.

Allain et al. (2004) "Correlations between the calculated stacking fault energy and the plasticity mechanisms in Fe—Mn—C alloys," Mater. Sci. Eng. A. 387-389:158-162.

(Continued)

*Primary Examiner* — Jennifer A Smith
*Assistant Examiner* — Alexandra M Moore
(74) *Attorney, Agent, or Firm* — Lathrop Gage LLP

(57) ABSTRACT

Disclosed herein are new face-centered cubic (f.c.c.) high-entropy alloys with compositions (in atomic %) of $Fe_aNi_b$-$Mn_cAl_dCr_eC_f$ where a is between 37-43 atomic %, b is between 8-14 atomic %, c is between 32-38 atomic %, d is 4.5-10.5 atomic %, e is between 2.5-9 atomic % and f is between 0-2 atomic %. The undoped alloy has strength of 159 MPa and 40% elongation to failure, but the doped, carbon-containing alloy having 1.1 atomic percent carbon has yield strength of 360 MPa, an ultimate tensile strength (UTS) of 1200 MPa and 50% elongation to failure at room temperature. At 700° C., the yield strength is 214 MPa with 24% elongation to failure. Thus, the present alloy may replace austenitic stainless steels in applications where better strength is needed at both room temperature and elevated temperature in an oxidation resistant alloy.

12 Claims, 13 Drawing Sheets

(56) References Cited

PUBLICATIONS

Baker et al. (1988) "The Effect of Boron on the Lattice Properties of Ni3Al," Acta Metallurgica. 36:493-499.
Baker et al. (Oct. 9, 2015) "Recrystallization of a Novel Two-Phase FeNiMnAlCr High Entropy Alloy," Journal of Alloys and Compounds. 656:458-464.
Baker et al. (1998) "The Room Temperature Strengthening Effect of Boron as a Function of Aluminum Concentration in FeAl," Intermetallics. 6:177-183.
Barbier et al. (2009) "EBSD for analysing the twinning microstructure in fine-grained TWIP steels and its influence on work hardening," J. Microsc. 235:67-78.
Bouaziz et al. (2011) "Effect of chemical composition on work hardening of Fe—Mn—C TWIP steels," Materials Science and Technology. 27:707-709.
Byun (2003) "On the stress dependence of partial dislocation separation and deformation microstructure in austenitic stainless steels," Acta Materialia. 51(11):3063-3071.
Cai et al. (2000) "A Hard X-ray Scanning Microscope for Fluorescence Imaging and Microdiffraction at the Advanced Photon Source," In; The Proceedings of the Sixth International Conference on X-ray Microscopy. Ed: Meyer-Ilse et al. 6 pgs.
Cantor et al. (2004) "Microstructural development in equiatomic multicomponent alloys," Mater. Sci. Eng. A. 375-377:213-218.
De Cooman et al. (2011) "High Mn TWIP Steels for Automotive Applications," Ch. 6 In; New Trends and Developments in Automotive System Engineering. Ed.: Chiaberge. IntechOpen. pp. 101-128.
Dejus et al. (2002) "A Magnetic properties and Spectral Performance," Report ANL/APS/TB-45. Argonne National Laboratory, Argonne, IL, USA.
Fleischer (1967) "The flow stress of body-centered cubic metals: inherent lattice hardening or solution hardening?" Acta Metall. 15(9):1513-1519.
Frommeyer et al. (2003) "Supra-ductile and high-strength manganese—TRIP/TWIP steels for high energy absorption purposes," ISIJ Int. 43:438-446.
Gali et al. (Aug. 2013) "Tensile properties of high- and medium-entropy alloys," Intermetallics. 39:74-78.
Gludovatz et al. (Sep. 5, 2014) "A fracture-resistant high-entropy alloy for cryogenic applications," Science. 5 345 (6201):1153-1158.
Gludovatz et al. (Aug. 19, 2015) "Processing, Microstructure and Mechanical Properties of the CrMnFeCoNi High-Entropy Alloy," J. Metals. 67:2262-2270.
Grässel et al. (1997) "Phase transformations and mechanical properties of Fe—Mn—Si—Al TRIP-steels," J Phys IV. 7:383-388.
Grässel et al. (2000) "High strength Fe—Mn—(Al, Si) TRIP/TWIP steels development-properties-application," Int. J. Plast. 16:1391-1409.
Guo et al. (May 16, 2016) "An atom probe perspective on phase separation and precipitation in duplex stainless steels," Nanotechnology. 27:254004.
Hsu et al. (2004) "Wear resistance and high-temperature compression strength of Fcc CuCoNiCrAl0.5Fe alloy with boron addition," Metall. Mater. Trans. A. 35(5):1465-1469.
Huang et al. (1984) "Boron extended solubility and strengthening potency in rapidly solidified Ni3Al," Acta Metallurgica. 32(10):1703-1707.
Huang et al. (1986) "Carbon effects in rapidly solidified Ni3Al," J. Mater. Res. 1(1):60-67.
Kang et al. (2010) "Effects of recrystallization annealing temperature on carbide precipitation, microstructure, and mechanical properties in Fe—18Mn—0.6C-1.5Al TWIP steel," Mater Sci Eng A. 527:745-751.
Labusch (1972) "Statistische theorien der mischkristallhärtung," Acta Metall. 20:917-927.
Libera et al. (2002) "Integration of a Hard X-ray Microprobe with a Diffractometer for Microdiffraction," Review of Scientific Instruments. 73(3):1506-1508.
Lu et al. (Jul. 3, 2015) "An Assessment on the future development of high-entropy alloys: summary from a recent workshop," Intermetallics. 66:67-76.
Miller et al. (2005) "Strategies for fabricating atom probe specimens with a dual beam FIB," Ultramicroscopy. 102:287-298.
Miller et al. (2007) "Performance of a local electrode atom probe," Surf. Interface Anal. 39:262-267.
Muira et al. (1968) "Orientation Dependence of the Flow Stress for Twinning in Silver Crystals," Trans. Jpn. Inst. Met. Suppl. 9:S555-S562.
Nabarro (1977) "The theory of solution hardening," Philos. Mag. 35:613-622.
Nelson et al. (1945) "An experimental investigation of extrapolation methods in the derivation of accurate unit-cell dimensions of crystals," Proc. Phys. Soc. 57:160-177.
Neu (Feb. 6, 2013) "Performance and Characterization of TWIP Steels for Automotive Applications," Materials Performance and Characterization. 2:244-284.
Otto et al. (Sep. 2013) "The influences of temperature and microstructure on the tensile properties of a CoCrFeMnNi high-entropy alloy," Acta Mater. 61:5743-5755.
Otto et al. (Apr. 2013) "Relative effects of enthalpy and entropy on the phase stability of equiatomic high-entropy alloys," Acta Mater. 61:2628-2638.
Park et al. (Oct. 8, 2014) "Recrystallization behavior of CoCrCuFeNi high-entropy alloy," Metall. Mater. Trans. A. 46A:1-7.
Rajasekhara et al. (2011) "Development of Stainless Steels with Superior Mechanical Properties: A Correlation Between Structure and Properties in Nanoscale/Sub-micron Grained Austenitic Stainless Steel," In; Advanced Steels: The Recent Scenario in Steel Science and Technology. Eds.: Weng et al. Springer. pp. 371-384.
Scott et al. (2006) "The development of a new Fe—Mn—C austenitic steel for automotive applications," Rev Metall. 103:293-302.
Sieurin et al. (2006) "Modelling solid solution hardening in stainless steels," Mater. Sci. Eng. A. 415:66-71.
Stepanov et al. (Apr. 2015) "Effect of cryo-deformation on structure and properties of CoCrFeNiMn high-entropy alloy," Intermetallics. 59:8-17.
Wang et al. (Nov. 2016) "The effect of interstitial carbon on the mechanical properties and dislocation substructure evolution in Fe40.4Ni11.3Mn34.8Al7.5Cr6 high entropy alloys," Acta Mater. 120:228-239.
Wang et al. (Sep. 1, 2015) "Atomic-size effects in crystalline lattices with multiple principal elements," Intermetallics. 64:63-69.
Wang et al. (Sep. 26, 2014) "Atomic-size effect and solid solubility of multicomponent alloys," Scripta Mater. 94:28-31.
Weihs et al. (1987) "The strength, hardness and ductility of Ni3Al with and without boron," Acta metall. 35:1109-1118.
Wu et al. (Mar. 2014) "Recovery, recrystallization, grain growth and phase stability of a family of FCC-structured multi-component equiatomic solid solution alloys," Intermetallics. 46:131-140.
Wu et al. (Jul. 20, 2013) "Microstructure and Mechanical Properties of Two-Phase Fe30Ni20Mn20Al30 Alloy, Part I: Microstructure," Journal of Materials Science. 48:7435-7445.
Wu et al. (Feb. 2014) "In-situ neutron diffraction study of deformation behavior of a multi-component high-entropy alloy," Appl. Phys. Lett. 104(5):051910.
Wu et al. (Oct. 25, 2015) "Nano-twin mediated plasticity in carbon-containing FeNiCoCrMn high entropy alloys," Journal of Alloys and Compounds. 647:815-822.
Yang (2010) "The Effect of Carbon Content of the Mechanical Properties & Microstructural Evolution of Fe—22Mn—C TWIP/WRIP Steel," Master of Applied Science Thesis, McMaster University.
Yeh et al. (2004) "Nanostructured High-Entropy Alloys with Multiple Principal Elements: Novel Alloy Design Concepts and Outcomes," Advanced Engineering Materials. 6(5):299-303.
Yen et al. (2012) "Interactions between deformation-induced defects and carbides in a vanadium-containing TWIP steel," Scr Mater. 66:1018-1023.
Zaddach et al. (Oct. 16, 2013) "Mechanical properties and stacking fault energies of NiFeCrCoMn high-entropy alloy," JOM. 65:1780-1789.

(56) References Cited

PUBLICATIONS

Zhang et al. (2008) "Solid-solution phase formation rules for multi-component alloys," Adv. Eng. Mater. 10 (6):534-538.
Zhu et al. (May 2013) "Incipient plasticity and dislocation nucleation of FeCoCrNiMn high-entropy alloy," Acta Mater. 61(8):2993-3001.

| Alloys | $C_0$ | $C_{0.07}$ | $C_{0.16}$ |
|---|---|---|---|
| Yield stress (MPa) | 159 ± 11 | 171 ± 3 | 181 ± 4 |
| UTS (MPa) | 535 ± 21 | 674 ± 26 | 713 ± 7 |
| Elongation (%) | 40.8 ± 2.5 | 51.6 ± 3.2 | 52.2 ± 2.0 |
| SHR (MPa) @ strain = 0.2 | 1236 ± 55 | 1313 ± 14 | 1360 ± 31 |
| Max. SHR (MPa) | 1273 ± 82 | 1350 ± 27 | 1400 ± 24 |

Figure 10A

| Alloys | $C_{0.30}$ | $C_{0.55}$ | $C_{1.10}$ |
|---|---|---|---|
| Yield stress (MPa) | 208 ± 6 | 274 ± 12 | 355 ± 7 |
| UTS (MPa) | 762 ± 27 | 960 ± 66 | 1174 ± 19 |
| Elongation (%) | 48.2 ± 0.9 | 52.3 ± 4.7 | 49.5 ± 0.6 |
| SHR (MPa) @ strain = 0.2 | 1506 ± 68 | 1542 ± 32 | 1895 ± 58 |
| Max. SHR (MPa) | 1591 ± 39 | 1854 ± 45 | 2239 ± 7 |

Figure 10B

OXIDATION RESISTANT HIGH-ENTROPY ALLOYS

CROSS-REFERENCE TO RELATED APPLICATIONS

This application claims the benefit of U.S. Provisional Application No. 62/266,414, filed Dec. 11, 2015, the entire content of which is incorporated herein by reference.

STATEMENT REGARDING FEDERALLY SPONSORED RESEARCH OR DEVELOPMENT

This invention was made with government support under DE-FG02-07ER46392 awarded by the US Department of Energy. The government has certain rights in the invention.

BACKGROUND

High-entropy alloys (HEAs) are defined as multicomponent alloys having at least five metallic elements with amounts in the range 5-35 atomic % (at. %) [1, 2]. There has been growing interest in HEAs since some can show high strength [3, 4], high ductility [5] and very high fracture toughness values, particularly at low temperatures [6]. Another interesting feature of HEAs is their sluggish diffusion, which means that following cold work recrystallization requires high annealing temperatures and can result in small grain sizes [5, 7, 8].

Substantial solid solution strengthening in single-phase HEAs likely arises from lattice distortions due to the elements having different atomic radii [5]. However, modeling the strengthening behavior of substitutional atoms in HEAs is problematic since it is not possible to define which are the solute atoms and which are the solvent atoms [5].

SUMMARY

Disclosed herein are new face-centered cubic (f.c.c.) high-entropy alloys (HEA) with compositions (in atomic %) including, e.g.: $Fe_{40.42}Ni_{11.28}Mn_{34.78}Al_{7.52}Cr_6$ and $Fe_{39.9}Ni_{10.4}Mn_{35.6}Al_{7.4}Cr_{5.6}C_{1.1}$. The undoped alloy has strength of 159 MPa and 40% elongation to failure, but the carbon-containing alloy having 1.1 atomic percent carbon has yield strength of 360 MPa, an ultimate tensile strength (UTS) of 1200 MPa and 50% elongation to failure at room temperature. At 700° C., the yield strength is 214 MPa with 24% elongation to failure. With the substantial amounts of Cr and Al in the alloy it is expected to be very resistant to oxidation and corrosion. By comparison, the most commonly used stainless steel 304 ($Fe_{74}Ni_{18}Cr_8$) has yield strength of 240 MPa, a UTS of 515 MPa and 40% elongation to failure at room temperature. At 650° C., the yield strength is 105 MPa with 34% elongation to failure. Thus, the present alloy has the potential to replace austenitic stainless steels in some applications where better strength is needed at both room temperature and elevated temperature in an oxidation resistant alloy.

The alloy is easily cast and can be cold rolled to at least 70% reduction in thickness. Following annealing at 1000° C., the alloy may be recrystallized to a 5 micron grain size. This processed material has a yield strength of 600 MPa and an elongation of 26%.

In an aspect, provided herein is a high-entropy alloy (HEA) having a formula of $Fe_aNi_bMn_cAl_dCr_eC_f$, where a is between 37-43 atomic %, b is between 8-14 atomic %, c is between 32-38 atomic %, d is 4.5-10.5 atomic %, e is between 2.5-9 atomic % and f is between 0-2 atomic %. In an embodiment, the high-entropy alloy (HEA) has a formula of $Fe_aNi_bMn_cAl_dCr_eC_f$ where a is between 38-42 atomic %, b is between 9-13 atomic %, c is between 33-37 atomic %, d is 5.5-9.5 atomic %, e is between 3.5-8 atomic % and f is between 0.5-1.5 atomic %. In an embodiment, the high-entropy alloy (HEA) has a formula of $Fe_aNi_bMn_cAl_dCr_eC_f$ where a is between 39-41 atomic %, b is between 10-12 atomic %, c is between 34-36 atomic %, d is 6.5-8.5 atomic %, e is between 4.5-7 atomic % and f is between 0.7-1.2 atomic %. In an embodiment, f is between 0.5 and 1.1 atomic %.

In another aspect, provided herein is a high-entropy alloy (HEA) having a formula of $Fe_aNi_bMn_cAl_dCr_eC_f$ where a is 37-43 atomic %, b is 8-14 atomic %, c is 32-38 atomic %, d is 4.5-10.5 atomic %, e is 2.5-9 atomic % and f is 0-2 atomic %. In an embodiment, a is 38-42 atomic %, b is 9-13 atomic %, c is 33-37 atomic %, d is 5.5-9.5 atomic %, e is 3.5-8 atomic % and f is 0.5-1.5 atomic %. In an embodiment, a is 39-41 atomic %, b is 10-12 atomic %, c is 34-36 atomic %, d is 6.5-8.5 atomic %, e is 4.5-7 atomic % and f is 0.7-1.2 atomic %.

In another aspect, provided herein is a high-entropy alloy (HEA) having a formula of $Fe_aNi_bMn_cAl_dCr_eC_f$ where a is 37-43 atomic %, b is 8-14 atomic %, c is 32-38 atomic %, d is 4.5-10.5 atomic %, e is 5-9 atomic % and f is 0-2 atomic %. In an embodiment, a is 37-43 atomic %, b is 8-14 atomic %, c is 32-38 atomic %, d is 5-10.5 atomic %, e is 5-9 atomic % and f is 0-2 atomic %. In an embodiment, a is 38-42 atomic %, b is 9-13 atomic %, c is 33-37 atomic %, d is 5.5-9.5 atomic %, e is 5-8 atomic % and f is 0.5-1.5 atomic %. In an embodiment, a is 39-41 atomic %, b is 10-12 atomic %, c is 34-36 atomic %, d is 6.5-8.5 atomic %, e is 5-7 atomic % and f is 0.7-1.2 atomic %.

In some embodiments, the HEA has the formula $Fe_{40.42}Ni_{11.28}Mn_{34.78}Al_{7.52}Cr_6$ or $Fe_{39.9}Ni_{10.4}Mn_{35.6}Al_{7.4}Cr_{5.6}C_{1.1}$, wherein the composition is expressed in terms of atomic percentages.

In an embodiment, the HEA has a face centered cubic structure.

In an embodiment, the HEA is a solid solution. For example, the solid solution may comprise interstitial carbon atoms.

In an embodiment, the HEA has a yield strength of at least 350 MPa, an ultimate tensile strength (UTS) of at least 1200 MPa, and an elongation to failure of at least 50% at room temperature.

for $Fe_{40.4}Ni_{11.3}Mn_{34.8}Al_{7.5}Cr_6$ HEAs having 0.0, 0.07, 0.16, 0.3, 0.55 and 1.1 atomic percent carbon.

Figure 8:
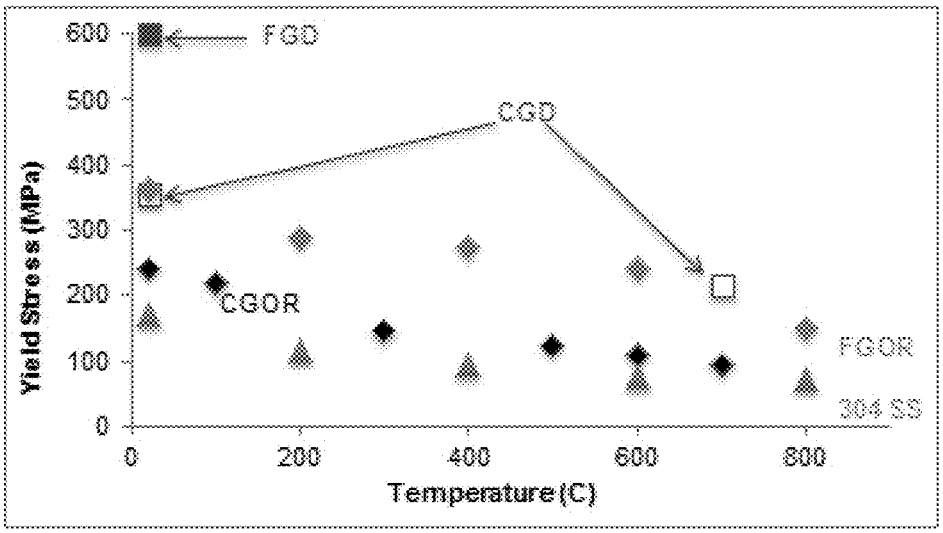

FIG. 8. Yield strength as a function of temperature for fine-grained (FGD) and coarse-grained (CGD) $Fe_{40.4}Ni_{11.3}Mn_{34.8}Al_{7.5}Cr_6$+1.1 atomic % C HEA, for the fine-grained (FGOR) and coarse-grained (CGOR) Oakridge National Laboratory (ORNL) FeNiCoCrMn HEA [88] and for 304 stainless steel (304SS).

Figure 9:
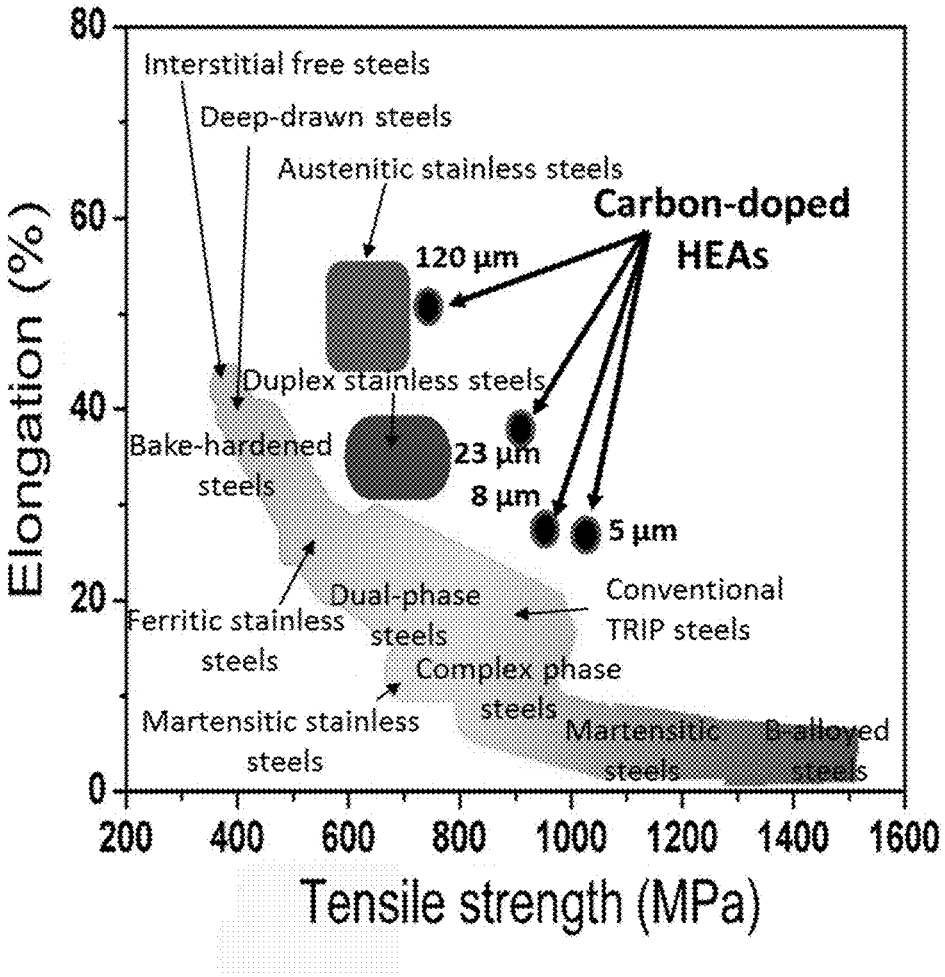

FIG. 9. 1.1 at. % C-doped HEAs as described herein, comparison with steels

FIG. 10A. Yield stress, ultimate tensile stress (UTS), elongation to fracture and strain hardening rate (SHR) for Fe40.4Ni11.3Mn34.8A17.5Cr6 HEAs with 0.0, 0.07 and 0.16 atomic percent carbon. Errors were calculated from three sets of measurements.

FIG. 10B. Yield stress, ultimate tensile stress (UTS), elongation to fracture and strain hardening rate (SHR) for $Fe_{40.4}Ni_{11.3}Mn_{34.8}Al_{7.5}Cr_6$ HEAs with 0.30, 0.55 and 1.1 atomic percent carbon. Errors were calculated from three sets of measurements.

Figure 11:
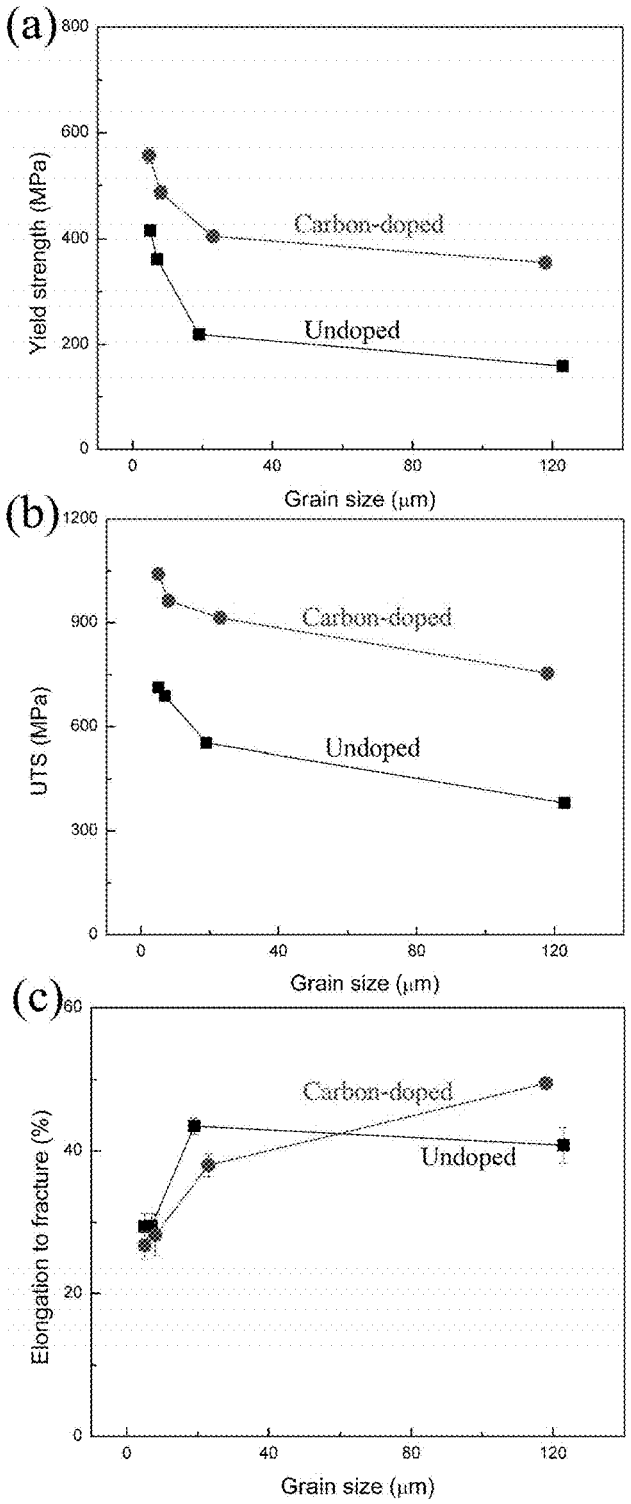

FIG. 11, (a)-(c). The variation of (a) yield strength, (b) UTS, and (c) elongation to fracture for the undoped HEA and the 1.1 at. % C-doped HEA with different grain sizes.

Figure 12:
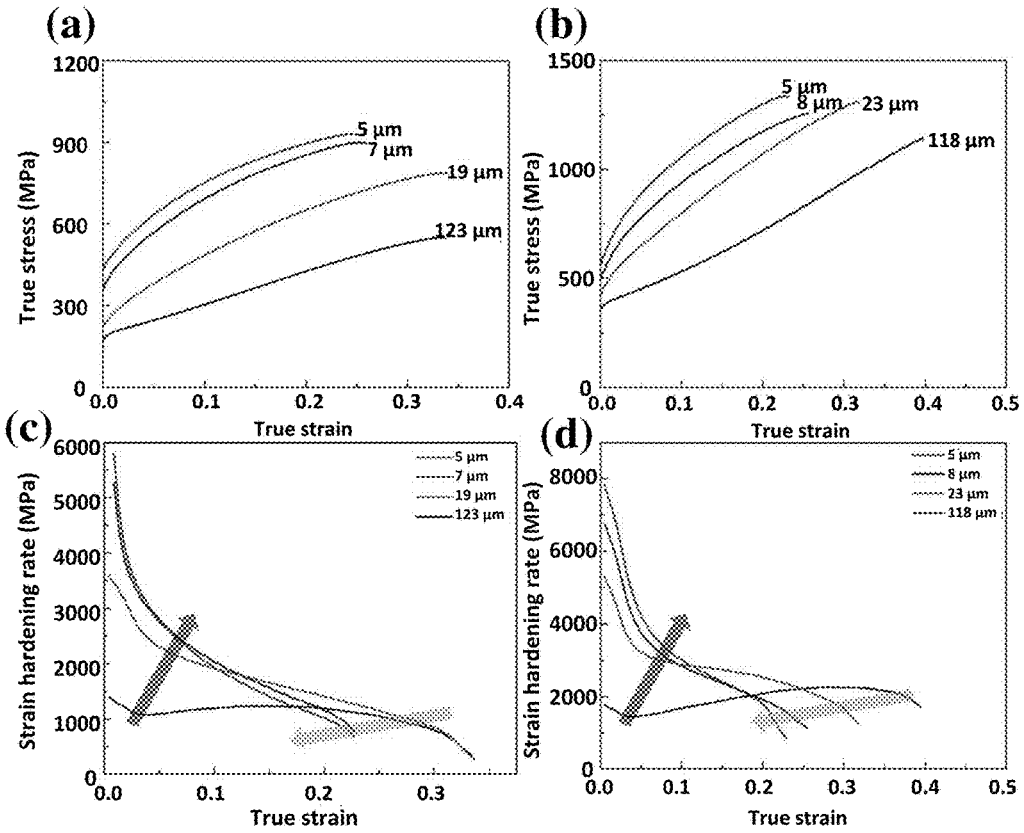

FIG. 12, (a)-(d). True stress-true strain curves and strain-hardening rate curves for (a, c) the undoped and (b, d) the 1.1 at. % C-doped HEA with different grain sizes. With the decrease of grain sizes, the strain hardening rate increases at the early stage of deformation as indicated by the dark arrow, while the strain hardening rate decreases at large strains as indicated by the yellow arrow.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

"Phase segregated" materials contain two or more phases, such as crystalline and amorphous phases, or two different crystalline phases. For example, two compositions of matter may phase separate or phase segregate in response to a stimulus into two phases.

"Domain" refers to a region of a material that is uniform within its boundaries, but different from a neighboring region. For example, a single crystalline material has a single domain.

The terms "direct" and "indirect" describe the actions or physical positions of one component or layer relative to another component or layer. For example, a component or layer that "directly" acts upon or touches another component or layer does so without intervention from an intermediary. Contrarily, a component or layer that "indirectly" acts upon or touches another component or layer does so through an intermediary (e.g., a third component).

Despite the increasing interest in high entropy alloys (HEAs), there have been no systematic studies of the effects of interstitials. This disclosure shows that carbon dissolves interstitially to 1.1 atomic % in a new single phase, f.c.c. HEA $Fe_{40.4}Ni_{11.3}Mn_{34.8}Al_{7.5}Cr_6$. (In contrast to carbon, boron additions also strengthen the alloy, but decrease the elongation to failure.) The yield strength is shown to increase linearly both with increasing carbon content and with lattice strain, which itself increases linearly with carbon content. Surprisingly, the carbon additions not only increase the yield strength, but also increase both the elongation to failure and the work-hardening rate, and for higher carbon contents the work-hardening rate also increases with increasing strain. These latter effects are related to the mechanical nanotwins that are observed at high strains. These observations bare some similarities to the behavior of twinning-induced plasticity (TWIP) steels. While it is not possible to use traditional models of strengthening to describe substitutional solid solutions [9], this disclosure shows substantial interstitial strengthening by carbon in a novel oxidation resistant f.c.c. alloy FeNiMnAlCr. The strengthening follows a linear relationship with the carbon content as opposed to classical models, which typically predict a $c^{1/2}$ or $c^{2/3}$ with the concentration, c [9, 43, 44]. Surprisingly, the carbon additions not only increase the strength, but also increase the ductility, and at high strains lead to a deformation nanotwinning, which produces an increase in work-hardening rate. It is worth noting that there have been no systematic studies of the strengthening effect of interstitials in HEAs. Indeed, there have been few studies of the effects of interstitials in HEAs except for a study by Wu et al. [10] of a single addition of 0.5 atomic % carbon to the most studied HEA FeNiCoCrMn [3, 5, 7, 11-14], although it is unclear whether all the carbon ended up in solution.

In the present work, six alloys of carbon-doped $Fe_{40.4}Ni_{11.3}Mn_{34.8}Al_{7.5}Cr_6$ HEAs were cast. All had grain sizes around 150 μm, suggesting that little strengthening from grain boundary (Hall-Petch) strengthening would be expected. With cold-rolling and annealing, or other thermo-mechanical processing routes, the grains size may be reduced considerably and, hence, the yield strength increased further. The carbon content of the ingots was determined by atomic absorption to be 0, 0.07, 0.16, 0.30, 0.55 and 1.10 atomic % (see Example 1).

Figure 1:
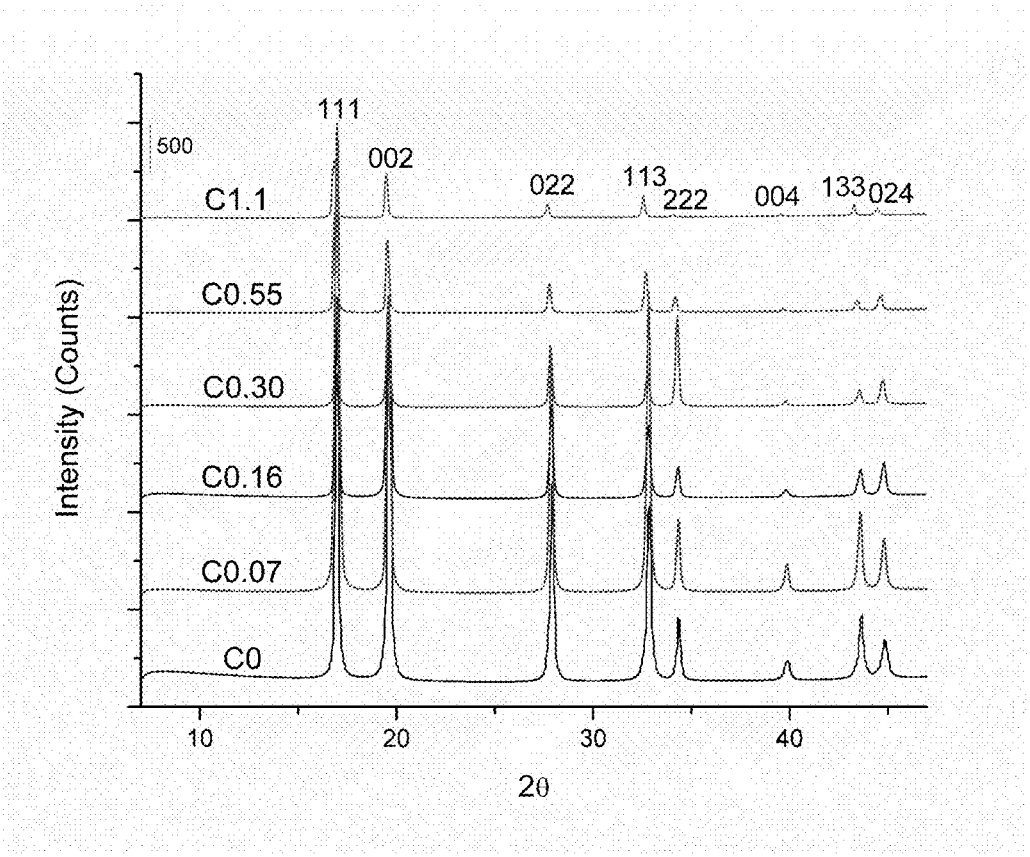
FIG. 1. XRD patterns from carbon-doped FeNiMnAlCr alloys. The atomic % of carbon is shown on each curve, all of which are single phase face centered cubic (f.c.c).

X-ray diffraction (XRD) showed that all the alloys were single phase with an f.c.c. structure, see FIG. 1. Both scanning electron microscope and transmission electron microscope observations corroborated the single-phase nature, i.e. no carbides were present, indicating that all the carbon was in solution. It is worth noting that it is difficult to compare interstitial carbon behavior in f.c.c. HEAs to the effect of carbon in f.c.c. metals at room temperature since carbon is almost insoluble in most metallic elements [15]. Interestingly, carbon is soluble, as noted above, up to possibly 0.5 atomic % in the f.c.c. HEA FeNiCoCrMn [10] (the carbon content of the alloy was not measured) and up to 5.5 atomic % in TWIP steels, which have a f.c.c. Fe—Mn matrix [16-28].

A number of parameters, based on atomic radii, have been developed in an effort to rationalize and predict the formation of single-phase HEAs, these include: δ, the standard deviation of the atomic radii [29], γ, a parameter that considers the biggest, smallest and average atomic radii in a multicomponent alloy [30], $\alpha_1$, a dimensionless parameter, which defines the shift of an atom due to differences in atomic radii from its ideal location [31], and $\alpha_2$, a dimensionless parameter, which defines the shift of pairs of atoms from their ideal position due to differences in atomic radii from the mean [31]. While it is understood that these parameters do not take into account features such as the enthalpy of mixing, the configurational entropy, configuration of valence electrons or the chemical bonding, the idea is that solid solution HEAs will exist over a well-defined range of values of these parameters, which separate them from both solid solutions that contain intermetallic compounds and metallic glasses [5]. It is worth considering whether these parameters predict the existence of the FeNiMnAlCr HEA. The parameter 8, which has values up to 0.2, does not appear to fully separate simple solid solutions from solid solutions that contain intermetallics, but we should note that for the FeNiMnAlCr studied here δ=0.03, which is a value for where only solid solutions have been recorded [5]. In contrast, the parameter y, which typically ranges from 0.9-3.2, has a clear cut-off value of 1.17 below which only solid solutions are found [5]. For FeNiMnAlCr γ=1.12, which is clearly in the solid solution range. The parameters $\alpha_1$ and $\alpha_2$, whose values range up to ~2.6 and ~0.14 respectively, do not clearly distinguish simple solid solutions from solid solutions containing intermetallics, and in the case of $\alpha_1$ from metallic glasses. For FeNiMnAlCr, $\alpha_1$=0.02 and $\alpha_2$=0.01, which are values for which only simple solid solutions have been reported [5]. Thus, all four parameters δ, γ, $\alpha_1$ and $\alpha_2$ that have been used to differentiate simple solid solution HEAs from solid solutions containing intermetallics and from metallic glasses show that FeNiMnAlCr is squarely within the solid solution HEA regime.

Figure 2A:
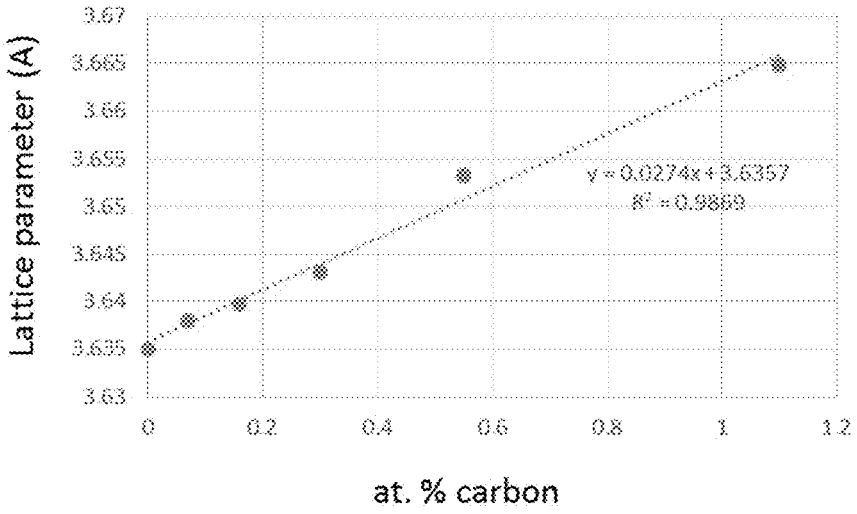
FIG. 2A. Lattice parameter versus atomic % carbon for FeNiMnAlCr alloys.
Figure 2B:
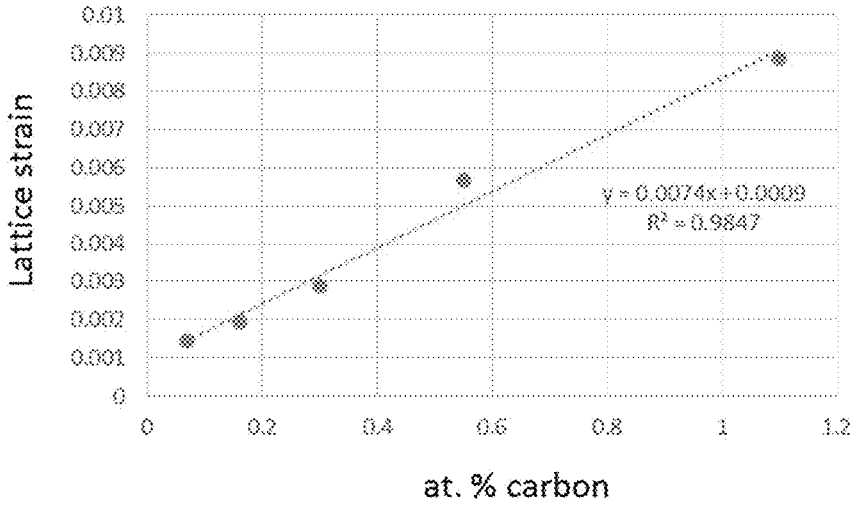
FIG. 2B. Lattice strain versus atomic % carbon for FeNiMnAlCr alloys.

The lattice parameter, a, determined using an extrapolation technique from the XRD data (see Example 1), increased with increasing carbon concentration, see FIG. 2A. The increase in lattice parameter, Δa, per change in atomic % carbon Δc, i.e. Δa/Δc is 2.74 pm/atomic % carbon, see FIG. 2B, produces a lattice strain or an increase in lattice parameter per atom fraction of carbon, ε=Δa/(Δc×a) of 0.75. As noted above, there is little data to compare this to for f.c.c. metals. However, Δa/Δc for a series of boron-doped cast specimens, with boron concentrations up to 1.12 atomic %, of the ordered face-centered cubic compound $Ni_3Al$ was measured to be 0.47 pm/atomic % B producing a value of ε that is roughly half (0.13) that measured for the FeNiMnAlCr HEA [32]. The values of ε of 0.75 for carbon doping of the HEA is substantially larger than the value of 0.26 measured for both boron [33] and carbon [34] doping of melt-spun $Ni_3Al$ ribbons, but comparable to that for the ordered body-centered cubic compound FeAl, which ranges from 1-1.55, depending on the Fe:Al ratio [35].

The binding energy of the carbon atoms to an edge dislocation, $U_m$, can be calculated using the lattice strain value, i.e. $U_m=G\ a^3\varepsilon/4$, where G is the shear modulus, assumed to be 80 GPa [39], which is typical of a number of f.c.c. metals. This yields a value of $7.2\times10^{-19}$ J. This is substantially larger than the value for carbon in iron ($1.66\times10^{-19}$ J), indicating a very strong interaction between the carbon atoms and edge dislocations, and, hence a substantial strengthening effect from carbon would be expected.

Figure 3A:
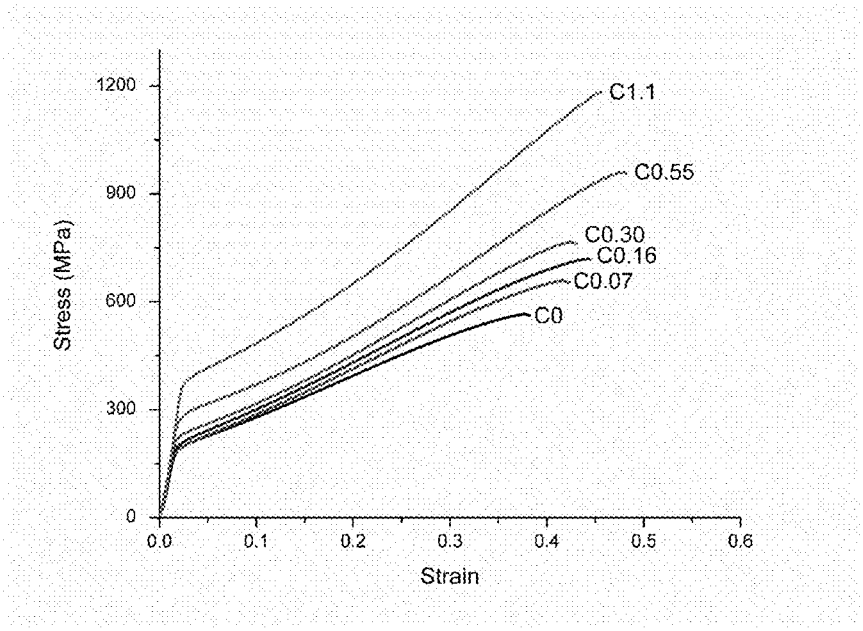
FIG. 3A. True stress as a function of true strain for carbon-doped FeNiMnAlCr alloys. The atomic % of carbon is shown on each curve.
Figure 3B:
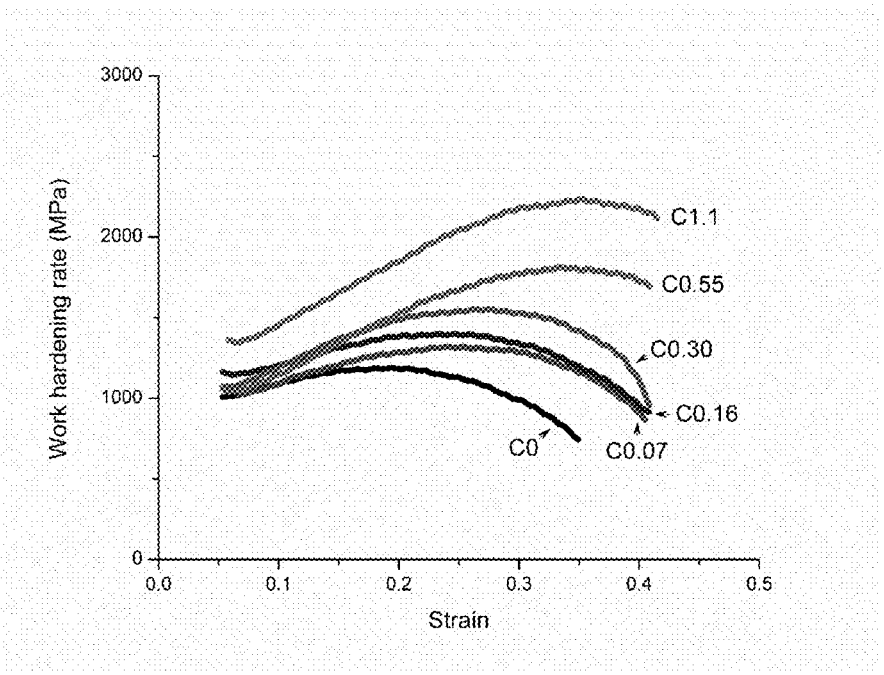
FIG. 3B. Work-hardening rate as a function of true strain for carbon-doped FeNiMnAlCr alloys. The atomic % of carbon is shown on each curve.
Figure 4A:
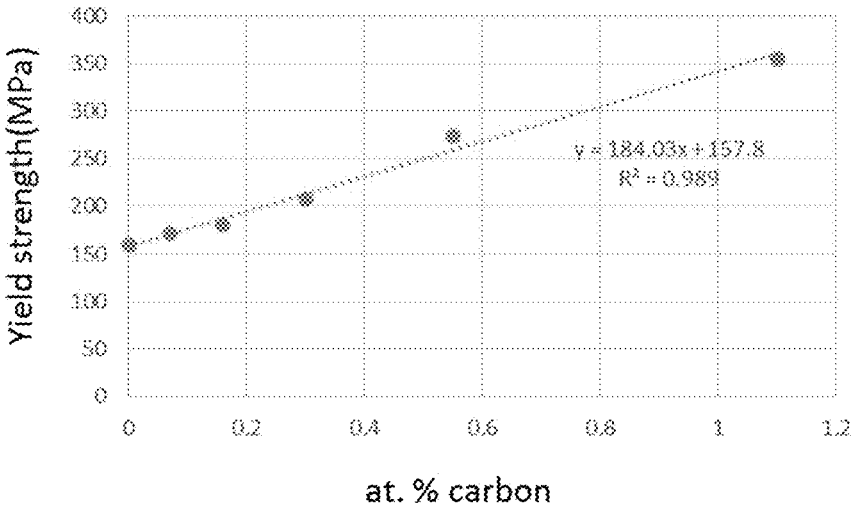
FIG. 4A. Yield strength versus percent carbon content in carbon-doped FeNiMnAlCr alloys.

FIG. 3 shows true stress-true strain curves and the work-hardening rate as a function of true strain for each of the FeNiMnAlCr HEAs strained to failure under tension (see Example 1 for testing details). The yield strength, $\sigma_y$, measured at room temperature shows a linear increase with increasing carbon content from 159 MPa for the carbon-free HEA to 355 MPa for the HEA containing 1.1 atomic % carbon, see FIG. 4A. This represents an increase in $\sigma_y$ per atomic % carbon, $\Delta\sigma_y/\Delta c$, of 184 MPa/atomic % C, which is somewhat less than the values reported for the boron strengthening effect in $Ni_3Al$ of 387-420 MPa/atomic % noted earlier [32, 36]. The increase in strength per fractional change in lattice parameter, $\sigma_y\Delta c\times1/\varepsilon$, is 0.31G, assuming a value for G of 80 GPa [39]. The $\Delta\sigma_y\Delta c$ value of 184 MPa/atomic % C is significantly greater than that found for carbon strengthening of 120 MPa/atomic % C in the HEA FeNiCoCrMn [10] and of 26-42 MPa/atomic % C determined for TWIP steel [23, 24].

Figure 4B:
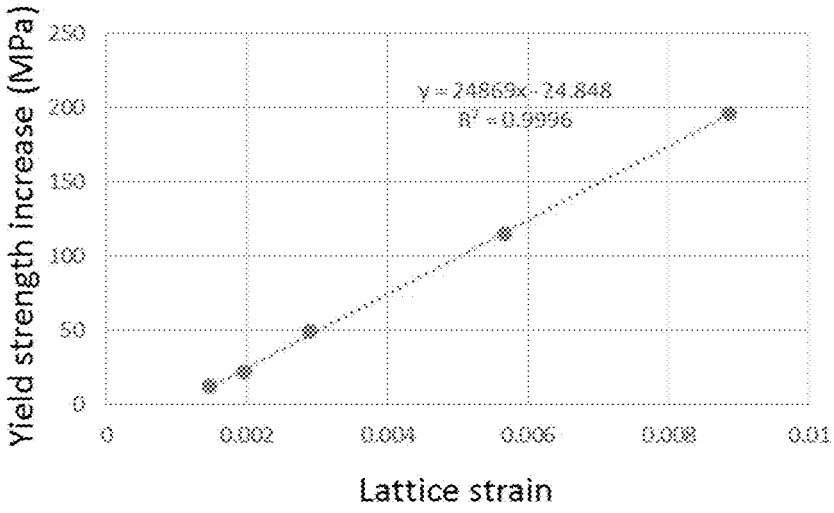
FIG. 4B. Yield strength increase versus lattice strain in carbon-doped FeNiMnAlCr alloys.

Classical models of solute strengthening typically predict a $c^{1/2}$ [9] or $c^{2/3}$ of dependence of $\sigma_y$ [43, 44] although, in practice a linear dependence of $\sigma_y$ on the concentration is often observed [37]. Since for carbon-doped FeNiMnAlCr both the yield strength and lattice strain show a linear dependence on the carbon concentration, the yield strength is also linearly related to the lattice misfit, see FIG. 4B (relating the strength simply to the lattice strain is reasonable for a small concentration of interstitial atoms since the other parameter that can influence the strength, the change in the elastic modulus, is likely to be very small [42].)

The work-hardening rate increases with increasing carbon content from ~1180 MPa at a true strain=0.2 for the carbon-free FeNiMnAlCr to 1880 MPa for FeNiMnAlCr+1.1 atomic % C at the same true strain, see FIG. 3. Further, while the carbon-free or low carbon HEAs show a constant or decreasing work-hardening rate with increasing strain similar to other HEAs [5, 6, 10, 11, 13], the high carbon content HEAs show an increasing work-hardening rate with increasing strain. The highest work-hardening rate was observed at a true strain of 0.4 for the HEA with 1.1 atomic % carbon of 2236 MPa or G/40 (again assuming a value of G of 80 MPa). This value of G/40 for the work-hardening rate is typical of many f.c.c. metals [38] or f.c.c. HEAs [4, 5]. We note that somewhat similar behavior is observed in TWIP steels, i.e. steels with low carbon contents show declining work-hardening with increasing strain, whereas steels with high carbon contents show a work-hardening rate that is largely independent of strain or, possibly increases slightly with increasing strain [24]. In TWIP steels this change in behavior is related to the occurrence of mechanical twinning in alloys with higher carbon contents.

Apart from increases in strength due to a reduction in grain size, most methods that increase the yield strength of metals decrease the ductility. Surprisingly, in the HEA studied here the addition of carbon not only increases the yield strength but also leads to an ~25% increase in elongation to failure from 41% for the undoped alloy to 52% for the alloy containing 0.16 atomic % C. This is again similar to behavior in TWIP steels [24, 27], where increasing carbon and manganese increase the extent of deformation twinning, which increases the ductility. This is in sharp contrast to the behavior of the HEA FeNiCoCrMn where the addition of 0.5 atomic % carbon produces a substantial decreases in ductility from ~75% to 40% elongation to failure [10]. This difference in behavior may be because both the carbon-free [6, 45, 47] and carbon-doped [10] FeNiCoCrMn exhibit deformation twinning, and, thus, the decrease in ductility in the carbon-doped HEA is simply related to the substantially greater fracture strength. The deformation twinning is promoted by the low stacking fault energy that has been calculated for FeNiCoCrMn [46].

Figure 5A:
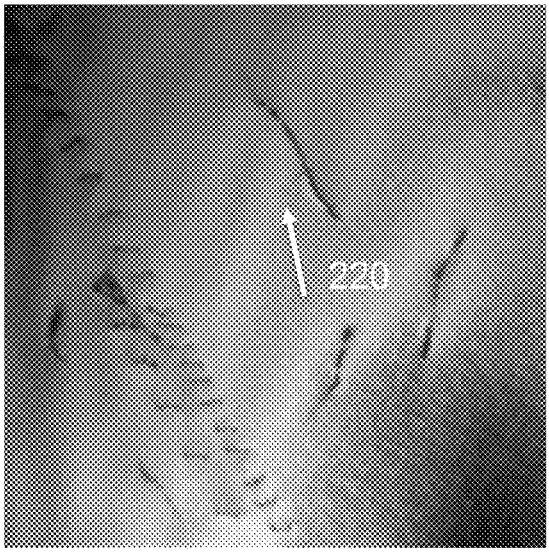
FIG. 5A. Bright field transmission electron micrographs of FeNiMnAlCr+1.1 atomic % C after 1% strain.
Figure 5B:
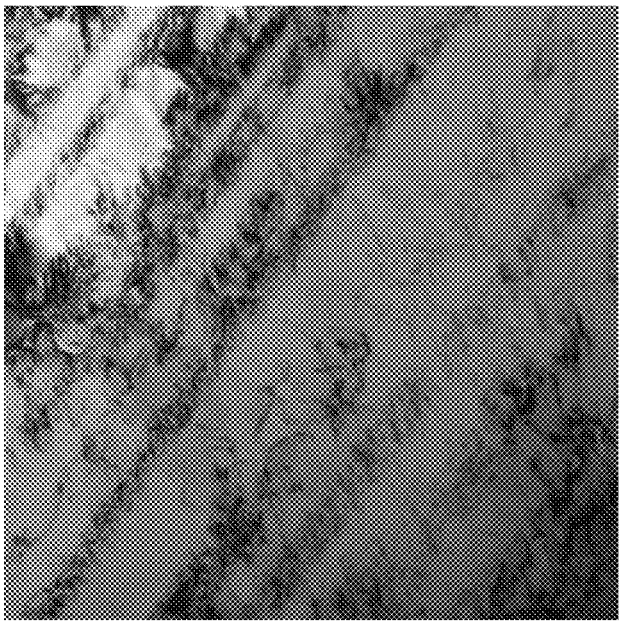
FIG. 5B. Bright field transmission electron micrographs of FeNiMnAlCr+1.1 atomic % C after 25% strain.
Figure 5C:
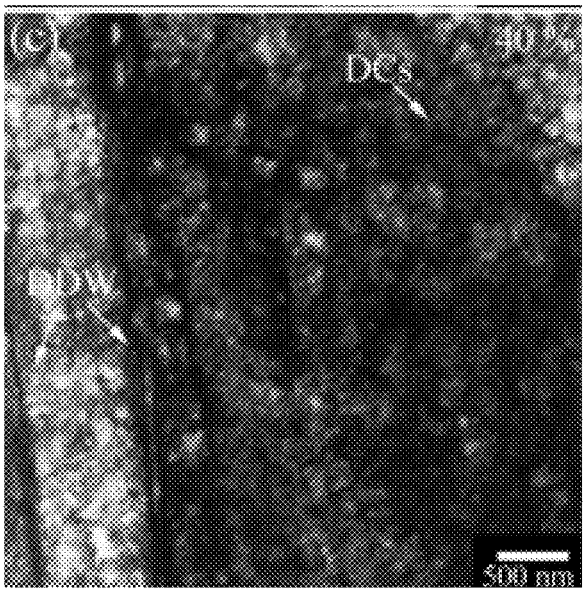
FIG. 5C. Bright field transmission electron micrographs of FeNiMnAlCr+1.1 atomic % C after 40% strain.
Figure 5D:
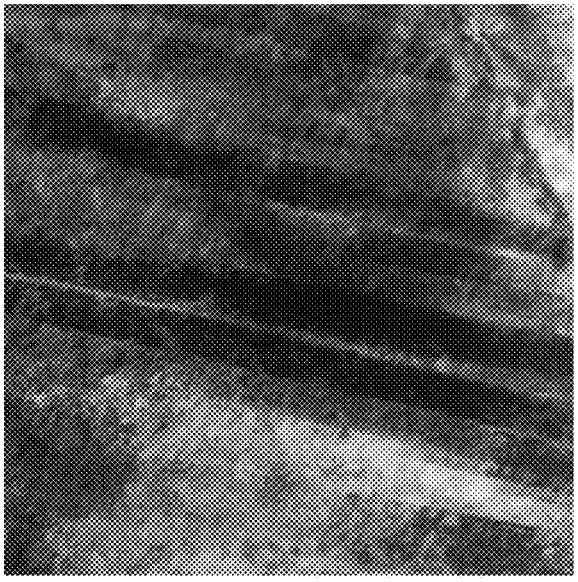
FIG. 5D. Bright field transmission electron micrographs of FeNiMnAlCr+1.1 atomic % C, fracture specimen.

Turning to the effect of deformation on the defect structure resulting from deformation, at low strains dislocations in linear arrays were noted in bright field transmission electron micrographs (see Example 1 for specimen preparation), suggesting that the HEAs have a low to medium stacking fault energy, see FIG. 5A. At intermediate strains, linear arrays of dislocations were observed, again suggesting that the FeNiMnAlCr HEAs have a low to medium stacking fault energy, see FIG. 5B. At high strains, in addition to individual dislocations, deformation twins are evident, see FIG. 5C, as confirmed by convergent beam electron diffraction patterns, see FIG. 5D. The stress required to nucleate deformation twinning increases rapidly with increasing stacking fault energy [40, 41]. In TWIP steels the deformation twinning is activated when the stacking fault energy is in the range 12-35 mJ. $m^{-2}$, while dislocation slip occurs at higher stacking fault energies and a martensitic transformation (arising when a/6<211> glide on alternating {111} slip planes) occurs for a stacking fault energy less than 18 mJ. $m^{-2}$ and slip [27]. Increasing the manganese and carbon content both increase the stacking fault energy, and, thus, promote deformation twinning. Similarly, in the FeNiMnAlCr HEAs disclosed herein, carbon produces a change from wavy to planar slip and, at high strains, to microband formation. In some embodiments, this leads to the increase in work-hardening rate, an increase in work-hardening at higher strains and increased ductility.

Figure 6A:
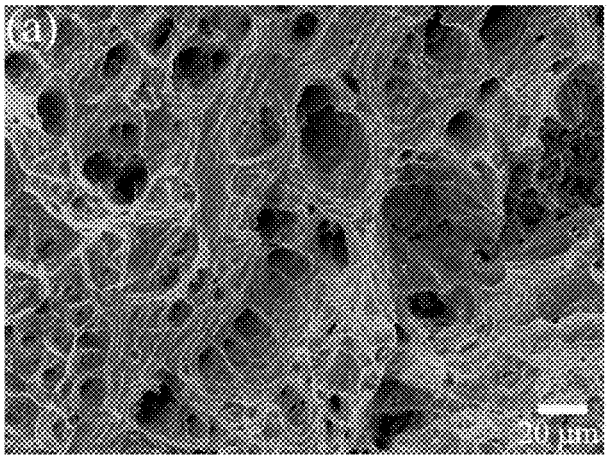
FIG. 6A. Secondary electron images showing fracture surface of undoped FeNiMnAlCr HEA.
Figure 6B:
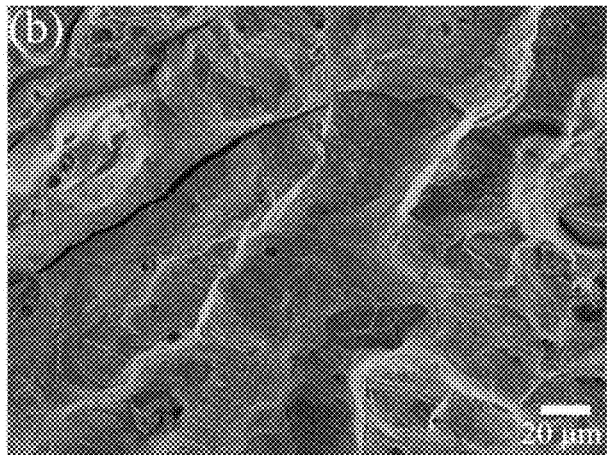
FIG. 6B. Secondary electron images showing fracture surface of (b) FeNiMnAlCr+1.1 atomic % C HEA.
Figure 7:
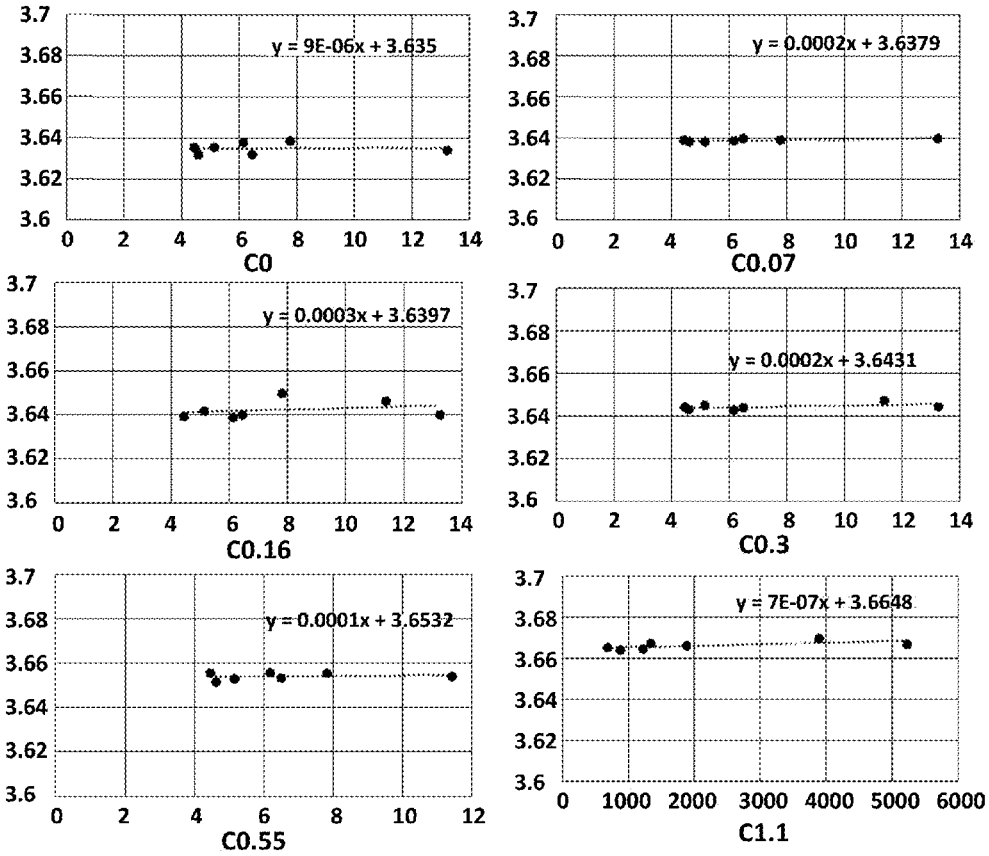
FIG. 7. Plot of measured values of the lattice parameter versus $$\frac{\cos^2\partial}{2}\left(\frac{1}{\sin\partial}+\frac{1}{\partial}\right)$$

Finally, it is worth noting how carbon changes the fracture mode. FIG. 6A shows the fracture surface of the undoped FeNiMnAlCr alloy. This shows a typical ductile fracture surface with elongated dimples. Interestingly, even though the FeNiMnAlCr alloy doped with 1.1 atomic % C shows 25% more elongation than the undoped alloy it no longer shows the typical dimple-type fracture surface. Instead, it shows features reminiscent of small localized cleavage steps.

Thermo-Mechanical Treatments

Thermo-mechanical treatments were performed on both undoped and 1.1 at. % C-doped, as-cast, single-phase, f.c.c. $Fe_{40.4}Ni_{11.3}Mn_{34.8}Al_{7.5}Cr_6$ HEAs, which refined the grain size producing a dramatic increase in strength. See Example 2. As shown in FIG. 9, the mechanical properties of 1.1 at. % C-doped HEAs are superior to those of most advanced steels. Properties of steels are from [S. Rajasekhara, L. P. Karjalainen, A. Kyröläinen, P. J. Ferreira, Advanced Steels: The Recent Scenario in Steel Science and Technology, in: Y. Weng, H. Dong, Y. Gan (Eds.), Springer Berlin Heidelberg, Berlin, Heidelberg, 2011: pp. 371-384] and the CoCrFeMnNi HEA with a grain size of 4.7 μm are from [F. Otto, A. Dlouhý, C. Somsen, H. Bei, G. Eggeler, E. P. George, Acta Mater. 61 (2013) 5743-5755].

It was found that the thermo-mechanical treatments also led to the formation of precipitates, which were found to both slightly increase the yield strength and decrease the ductility. TEM studies were used to determine the dislocation substructure evolution for the HEAs, and to illuminate the deformation mechanisms. Thus, the yield strength of the HEAs was evaluated based on microstructure-related models to reveal the effectiveness of the underlying strengthening mechanisms.

Thermo-mechanical treatments led to the presence of B2 precipitates in the undoped HEA, and the formation of B2 precipitates, $M_7C_3$ and $M_{23}C_6$ carbides in the C-doped HEA depending on the annealing conditions.

The refinement of grain size and the occurrence of precipitates after thermo-mechanical treatments result in a remarkable increase in strength in both undoped and C-doped HEAs with an acceptable reduction in ductility.

Terms and Definitions

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, and method steps set forth in the present description. As will be obvious to one of skill in the art, methods and devices useful for the present methods can include a large number of optional composition and processing elements and steps.

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomer and enantiomer of the compound described individually or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently. It must be noted that as used herein and in the appended claims, the singular forms "a", "an", and "the" include plural reference unless the context clearly dictates otherwise. Thus, for example, reference to "a cell" includes a plurality of such cells and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably.

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements, limitation or limitations which is not specifically disclosed herein. One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

Example 1

Material Preparation

Six ~50 g ingots of nominal atomic composition $Fe_{40.4}Ni_{11.3}Mn_{34.8}Al_{7.5}Cr_6$ doped with different levels of carbon were produced from pieces of 99.8% Fe, 99.95% Ni, 99.8% Mn, 99.8% Al, 99.8% Cr and FeC. An additional 5 wt. % Mn was added to compensate for the loss of Mn by evaporation during melting. The pieces were arc-melted in a water-chilled copper crucible under an argon atmosphere. The ingots were flipped and re-melted twice to ensure a homogeneous mixture. The chemical composition of the ingots was determined using ASTM E1019; other compositions were determined per ASTM E1621 test procedures by Chicago Spectro Service Laboratory, Inc, Chicago, Ill., see Table 1. The grain size, measured using the linear intercept method, of all the ingots was similar at ~150 μm.

TABLE 1

| | | | | | |
|---|---|---|---|---|---|
| Iron | Balance | Balance | Balance | Balance | Balance |
| Nickel | 10.13 at. % | 11.58 at. % | 10.05 at. % | 10.21 at. % | 10.35 at. % |
| Manganese | 35.25 at. % | 35.55 at. % | 32.25 at. % | 35.46 at. % | 35.67 at. % |
| Aluminum | 7.20 at. % | 7.10 at. % | 7.35 at. % | 7.39 at. % | 7.40 at. % |
| Chromium | 5.52 at. % | 5.01 at. % | 5.20 at. % | 5.31 at. % | 5.55 at. % |
| Carbon | 0.07 at. % | 0.16 at. % | 0.30 at. % | 0.55 at. % | 1.10 at. % |

X-Ray Diffraction

X-ray diffraction (XRD) patterns were obtained at the Advanced Photon Source (APS) at Argonne National Laboratory, using the hard X-ray microdiffraction facility at Beamline 2-ID-D [49]. The X-ray radiation was generated from a 7 GeV electron beam and an APS undulator A [50] in the storage ring. 10.1 keV X-rays (wavelength=0.1228 nm) were selected using a double-crystal Si <111> monochromator. The X-ray beam was focused down to a circular spot of 200 nm using zone-plate focusing optics and delivered to the sample at a flux ~$3\times10^9$ photons $s^{-1}$ [49]. The sample was mounted on a six-circle kappa geometry diffractometer [51], which was also used to manipulate its angular position. A Rayonix Mar165 CCD detector, with a 80 micron pixel size containing 2048×2048 pixels was mounted about 23 mm downstream of the sample to collect diffracted X-rays. The sample was continuously rotated during data collection, along an axis perpendicular to the incident beam by 80° in order to capture a greater number of diffraction spots. The total count time was 21 s. The background was stripped using power law subtraction.

The position of each peak was measured on the diffractogram from which the lattice parameter was calculated. The measured lattice parameters were plotted versus $$\frac{\cos^2\vartheta}{2}\left(\frac{1}{\sin\vartheta}+\frac{1}{\vartheta}\right), \quad [52]$$

where θ is the Bragg angle for each peak and the resulting graph was extrapolated to zero to obtain the best value of the lattice parameter.

Tensile Testing

Dog-bone-shaped tensile test specimens (gauge length ~10 mm; width ~2.54 mm; and thickness ~1.27 mm) were machined from the ingots. The tensile specimens were polished through increasingly fine grades of silicon carbide papers and finally polished using 0.3 μm alumina powder. Three tensile tests were performed for each alloy at constant displacement rate of 0.005 mm $s^{-1}$, corresponding to an initial strain rate of $5\times10^{-4}$ $s^{-1}$. The strain determined during loading from the crosshead displacement, was corrected by the strain measured directly from the specimen after fracture. The resulting engineering stress-engineering strain curves were then converted into true stress-true strain curves.

Scanning Electron Microscopy

Polished and etched as-cast specimens and fracture surfaces after mechanical testing were examined using secondary electron imaging on a FEI XL30 field emission gun (FEG) scanning electron microscope operated at 15 kV.

Transmission Electron Microscopy

Three mm diameter disks were produced for transmission electron microscope (TEM) examination by electro-discharge machining and ground to ~200 mm thickness. They were electropolished in an electrolyte of 20% nitric acid, 10% butoxyethanol and 70% methanol using a Struers Tenupol 5 at a voltage of ~10 V with a current of ~40 mA at ~260 K [48]. Electropolished thin foils were alternately washed in ethanol and methanol for three cycles prior to a final rinse in methanol and examined using an FEI Tecnai F20 FEG TEM operated at 200 kV.

Example 2

Approximately 65 g ingots of undoped and 1.1 at. % C-doped $Fe_{40.4}Ni_{11.3}Mn_{34.8}Al_{7.5}Cr_6$ HEAs were prepared by arc-melting. Details of the arc melting procedures are described in [Z. Wang, I. Baker, Z. Cai, S. Chen, J. D. Poplawsky, W. Guo, Acta Mater. 120 (2016) 228-239]. Both HEAs were subsequently cold rolled to a 70% reduction in thickness, followed by annealing at 1073 K for 8 h, 1073 K for 30 h, and 1173 K for 8 h for the undoped HEA, and at 1073 K for 8 h, 1173 K for 8 h, 1273 K for 1 h, 1273 K for 8 h, and 1373 K for 4 h for the C-doped HEA, respectively. The higher annealing temperatures were used for the C-doped HEA since recrystallization did not occur upon annealing at the lower temperatures of 1173 K for times up 8 h.

X-ray diffraction (XRD) analysis was conducted on the HEAs by using a Rigaku D/MAX 2000 diffractometer with Cu-Kα radiation. The operating voltage and current were 40 keV and 300 mA, respectively. A step size of 0.02° with a scanning angle (2θ) from 30° to 100° was used. The total scanning time was approximate 70 minutes. The extrapolation function cos^2 θ/2 (1/sin θ+1/θ) [J. B. Nelson, D. P. Riley, Proc. Phys. Soc. 57 (1945) 160-177], where θ is the Bragg angle for each peak, was used to calculate the lattice constant of the C-doped HEA after the thermo-mechanical treatment. The X-ray wavelength is 1.5418 Å.

A FEI XL-30 field emission gun (FEG) scanning electron microscope (SEM) in backscattered electron (BSE) mode was employed to examine the microstructures of the HEAs. Specimens for SEM examination were ground using silicon carbide paper from 400 grit to 1200 grit, and then polished using a 0.3 μm alumina suspension, before finishing in a Vibromet polishing machine using a 60 nm colloidal silica suspension. The volume fractions and sizes of precipitates in HEAs were evaluated from BSE images using Image J. The projected areas for at least 300 precipitates were measured for each heat treatment. The particle size reported is an equivalent circle diameter for a spherical particle calculated from the measured area. The grain size was determined using the linear intercept method with at least 30 intercepts.

A FEI Tecnai F20 FEG transmission electron microscope (TEM) equipped with energy dispersive X-ray spectrometry (EDS) operated at 200 kV was used to examine the microstructures and the dislocation substructure evolution of the HEAs. For TEM examination, 3 mm diameter disks with a thickness of 150 μm were electro-polished using a Struers Tenupol 5 in an electrolyte of 25% nitric acid in methanol at a temperature of ~250 K with an applied voltage of ~11 V and current of ~80 mA.

The atomic distribution in the grain boundaries of the recrystallized 1.1 at. % C-doped HEA was characterized using atom probe tomography (APT). A dual FIB-SEM system (FEI Nova 200) was employed to prepare needle-shaped APT tips from grain boundary regions following procedures described elsewhere [see (1) M. K. Miller, K. F. Russell, G. B. Thompson, Ultramicroscopy. 102 (2005) 287-298; (2) W. Guo, D. A. Garfinkel, J. D. Tucker, D. Haley, G. A. Young, J. D. Poplawsky, Nanotechnology. 27 (2016) 254004]. APT measurements were performed using a local electrode atom probe (CAMECA LEAP 4000× HR) with a 50 pJ laser energy, a repetition rate of 200 kHz, and a specimen temperature of 50 K [M. K. Miller, K. F. Russell, Surf. Interface Anal. 39 (2007) 262-267]. IVAS 3.6.12 software (CAMECA Instruments) was used to reconstruct and analyze the resulting datasets. Dog-bone shaped specimens with a gauge length of ~10 mm, width of ~2.6 mm, and thickness of ~1.2 mm were used for tensile tests on an Instron 5969 testing machine. Three specimens with mirror surfaces were tested for each alloy at an initial strain rate of 5×10−4 s−1 at room temperature. The elongation was determined by measuring the gauge length of specimens before and after tests using an optical microscope.

TABLE 2

Grain size, precipitate size and volume fraction of the undoped and 1.1 at. % C-doped HEAs after 70% cold rolling and annealing at the temperatures shown. The $M_{23}C_6$ and $M_7C_3$ carbides are counted together since they have the same strengthening effects.

| Alloy | Annealing condition | Grain size (μm) | Precipitate diameter (nm) | Precipitate fraction (%) |
|---|---|---|---|---|
| Undoped | 1073 K, 8 h | 5 | 141 | 13.0 |
| | 1073 K, 30 h | 7 | 441 | 14.3 |
| | 1173 K, 8 h | 19 | 884 | 4.3 |
| 1.1 at. % | 1273 K, 1 h | 5 | 600 | 13.4 |
| C-doped | 1273 K, 30 h | 8 | 929 | 11.3 |
| | 1373 K, 4 h | 23 | 1928 | 2.9 |

TABLE 3

The yield strength ($\sigma_y$), precipitation strength ($\sigma_{ppt}$), reduced yield strength ($\sigma'_y$), reduction in lattice friction stress ($\Delta\sigma_{fr}$), lattice friction stress ($\sigma_{fr}$), and Hall-Petch slope (k) for undoped and 1.1 at. % C-doped HEAs with various grain size (d).

| Alloy | d (μm) | $\sigma_y$ (MPa) | $\sigma_{ppt}$ (MPa) | $\sigma'_y$ (MPa) | $\Delta\sigma_{fr}$ (MPa) | $\sigma_{fr}$ (MPa) | k (MPa · μm$^{-0.5}$) |
|---|---|---|---|---|---|---|---|
| Undoped | 5 μm | 416 | 76 | 340 | — | 102 | 534 |
| | 7 μm | 361 | 47 | 314 | — | | |
| | 19 μm | 219 | 12 | 207 | — | | |
| 1.1 at. % | 5 μm | 557 | 54 | 503 | 67 | 313 | 574 |
| C-doped | 8 μm | 488 | 38 | 450 | 61 | | |
| | 23 μm | 405 | 9 | 396 | 33 | | |

REFERENCES

1. J. W. Yeh, S. K. Chen, S. J. Lin, J. Y. Gan, T. S. Chin, T. T. Shun, C. H. Tsau, and S. Y. Chang, "Nanostructured High-Entropy Alloys with Multiple Principal Elements: Novel Alloy Design Concepts and Outcomes. Advanced Engineering Materials", 6(5) (2004): p. 299-303.
2. C.-Y. Hsu, J.-W. Yeh, S.-K. Chen, and T.-T. Shun, "Wear resistance and high-temperature compression strength of Fcc CuCoNiCrAl0.5Fe alloy with boron addition", Metall. Mater. Trans. A 35 (5) (2004): 1465-1469.
3. B. Cantor, I. T. H. Chang, P. Knight, A. J. B. Vincent, "Microstructural development in equiatomic multicomponent alloys", Mater. Sci. Eng. A 375-377 (2004): 213-218.
4. Y. Wu, W. H. Liu, X. L. Wang, D. Ma, A. D. Stoica, T. G. Nieh, Z. B. He, Z. P. Lu, "In-situ neutron diffraction study of deformation behavior of a multi-component high-entropy alloy", Appl. Phys. Lett. 104 (5) (2014): 051910.
5. Z. P. Lu, H. Wang, M. W. Chen, I. Baker, J. W. Yeh, C. T. Liu and T. G. Nieh, "An Assessment on the future development of high-entropy alloys: summary from a recent workshop", Intermetallics, 66 (2015): 67-76.
6. B. Gludovatz, A. Hohenwarter, D. Catoor, E. H. Chang, E. P. George and R. O. Ritchie "A fracture-resistant high-entropy alloy for cryogenic applications, Science, 5 345(6201) (2014), 1153-1158.
7. N. Park, I. Watanabe, D. Terada, Y. Yokoyama, P. Liaw, N. Tsuji, "Recrystallization behavior of CoCrCuFeNi high-entropy alloy", Metall. Mater. Trans. A 46A (2014): 1-7.
8. I. Baker, F. Meng, M. t Wu and A. Brandenberg, "Recrystallization of a Novel Two-Phase FeNiMnAlCr High Entropy Alloy", Journal of Alloys and Compounds, 656 (2016): 458-464.
9. R. L. Fleischer, "The flow stress of body-centered cubic metals: inherent lattice hardening or solution hardening?" Acta Metall. 15 (9) (1967): 1513-1519.
10. Z. Wu, C. M. Parish and H. Bei, "Nano-twin mediated plasticity in carbon-containing FeNiCoCrMn high entropy alloys", Journal of Alloys and Compounds, 647 (2015): 815-822.
11. A. Gali and E. P. George, "Tensile properties of high- and medium-entropy alloys" Intermetallics, 39 (2013): 74.
12. F. Otto, Y. Yang, H. Bei H, and E. P. George, "Relative effects of enthalpy and entropy on the phase stability of equiatomic high-entropy alloys", Acta Mater. 61 (2013): 2628.
13. Z. Wu, H. Bei, F. Otto, G. M. Pharr, and E. P. George, "Recovery, recrystallization, grain growth and phase stability of a family of FCC-structured multi-component equiatomic solid solution alloys", Intermetallics, 46 (2014): 131-140.
14. C. Zhu, Z. P. Lu, and T. G. Nieh, "Incipient plasticity and dislocation nucleation of FeCoCrNiMn high-entropy alloy", Acta Mater. 61(8) (2013): 2993.
15. Binary Alloy Phase Diagrams, ASM, 1986. Editor in Chief T. B. Massalski
16. G. Frommeyer, U. Brüx, P. Neumann, "Supra-ductile and high-strength manganese-TRIP/TWIP steels for high energy absorption purposes", ISIJ Int, 43 (2003): 438.
17. O. Grässel, G. Frommeyer, C. Derder, H. Hofmann, "Phase transformations and mechanical properties of Fe—Mn—Si—Al TRIP-steels", J Phys IV 7 (1997): 383.
18. O. Grässel, L. Krüger, G. Frommeyer, L. Meyer. "High strength Fe—Mn—(Al, Si) TRIP/TWIP steels development-properties-application," Int. J. Plast. 16 (2000): 1391.
19. S. Allain, J. P. Chateau, O. Bouaziz, "A physical model of the twinning-induced plasticity effect in a high manganese austenitic steel," Mater. Sci. Eng. A 387 (2004): 143.
20. S. Allai, J. P. Chateau, O. Bouaziz, S. Migot, N. Guelton, "Correlations between the calculated stacking fault energy and the plasticity mechanisms in Fe—Mn—C alloys," Mater. Sci. Eng. A 387 (2004): 158.
21. H. W. Yen, M. Huang, C. Scott, J. R. Yang, "Interactions between deformation-induced defects and carbides in a vanadium-containing TWIP steel," Scr Mater 66 (2012): 1018.
22. C. Scott, S. Allain, M. Faral, N. Guelton, "The development of a new Fe—Mn—C austenitic steel for automotive applications," Rev Metall 103 (2006): 293.
23. E. E. Yang, "The Effect of Carbon Content of the Mechanical Properties & Microstructural Evolution of Fe-22Mn—C TWIP/WRIP Steel", Master of Applied Science Thesis, McMaster University, 2010.
24. O. Bouaziz, H. Zurob, B. Chehab, J. D. Embury, S. Allain and M. Huang, "Effect of chemical composition on work hardening of Fe—Mn—C TWIP steels", Materials Science and Technology, 27 (2011): 707-709.
25. S. Kang, Y. S. Jung, J. H. Jun, Y. K. Lee, "Effects of recrystallization annealing temperature on carbide precipitation, microstructure, and mechanical properties in Fe-18Mn-0.6C-1.5Al TWIP steel," Mater Sci Eng A 527 (2010): 745.
26. B. C. Cooman, K. Chin, J. Kim, "High Mn TWIP Steels for Automotive Applications" In: Chiaberge M., editor, New Trends and Developments in Automotive System Engineering. 2011. Intech 27. R. W. Neu, "Performance and Characterization of TWIP Steels for Automotive Applications," Materials Performance and Characterization, 2 (2013): 244-284.
28. D. Barbier, N. Gey, N. Bozzolo, S. Allain and M. Humbert, "EBSD for analysing the twinning microstructure in fine-grained TWIP steels and its influence on work hardening", J. Microsc., 235, (2009): 67-78.
29. Y. Zhang, Y. J. Zhou, J. P. Lin, G. L. Chen, P. K. Liaw, "Solid-solution phase formation rules for multi-component alloys", Adv. Eng. Mater. 10 (6) (2008): 534-538.
30. Z. Wang, Y. Huang, Y. Yang, J. Wang, C. T. Liu, "Atomic-size effect and solid solubility of multicomponent alloys", Scripta Mater. 94 (2015): 28-31.
31. Z. J. Wang, W. F. Qiu, Y. Yang, C. T. Liu, "Atomic-size effects in crystalline lattices with multiple principal elements", Intermetallics 64 (2015): 63-69.
32. I. Baker, B. Huang and E. M. Schulson, "The Effect of Boron on the Lattice Properties of $Ni_3Al$", Acta Metallurgica, 36 (1988): 493-499.
33. S. C. Huang, A. I. Taub and K.-M. Chang, "Boron extended solubility and strengthening potency in rapidly solidified $Ni_3Al$", Acta metall. 32(10) (1984):1703.
34. S. C. Huang, C. L. Briant, K.-M. Chang, A. I. Taub and E. L. Hall, "Carbon effects in rapidly solidified $Ni_3Al$", J. Mater. Res. 1 (1) (1986): 60.
35. I. Baker, X. Li, H. Xiao, R. L. Carleton and E. P. George, "The Room Temperature Strengthening Effect of Boron as a Function of Aluminum Concentration in FeAl", Intermetallics, 6 (1998): 177-183.
36. T. P. Weihs, V. Zinoviev, D. V. Viens and E. M. Schulson, Acta metall. 35, 1109 (1987).
37. R. W. K. Honeycombe, The Plastic Deformation of metals. William Cloves and Sons, London. 1975.
38. R. E. Smallman, Modern Physical Metallurgy, $8^{th}$ Edition, 2013, Butterworth-Heinemann, Oxford, U.K.
39. B. Gludovatz, E. P. George and R. O. Ritchie, "Processing, Microstructure and Mechanical Properties of the CrMnFeCoNi High-Entropy Alloy", J. Metals, 67 (2015) 2262-2270.
40. Muira S., Takamura J. I., Narita N. (1968), Trans. J. Inst. Met. Suppl., 9, S555
41. Byun T. S. (2003), Acta Materialia, Volume 51, Issue 11, Pages 3063-3071.
42. H. Sieurin, J. Zander and R. Sandstrom: Mater. Sci. Eng. A, A415 (2006) 66-71.
43. R. Labusch, Acta Met. 20 (1972) 917-927.
44. F. R. N. Nabarro, Philos. Mag. 35 (1977) 613-622.
45. N. Stepanov, M. Tikhonovsky, N. Yurchenko, D. Zyabkin, M. Klimova, S. Zherebtsov, A. Efimov and G. Salishchev, "Effect of cryo-deformation on structure and properties of CoCrFeNiMn high-entropy alloy", Intermetallics 59 (2015) 8-17.
46. Zaddach A J, Niu C, Koch C C, Irving D L. Mechanical properties and stacking fault energies of NiFeCrCoMn high-entropy alloy. JOM 2013; 65:1780-1789.
47. Otto F, Dlouhyr' A, Somsen Ch, Bei H, Eggeler G, George E P. The influences of temperature and microstructure on the tensile properties of a CoCrFeMnNi high-entropy alloy. Acta Mater 2013; 61:5743-5755.
48. X. Wu, I. Baker, H. Wu. M. K. Miller, K. L. More, Z. Cai and S. Chen, "Microstructure and Mechanical Properties of Two-Phase $Fe_{30}Ni_{20}Mn_{20}Al_{30}$ Alloy, Part I: Microstructure", Journal of Materials Science, 48 (2013) 7435-7445.
49. Z. Cai, B. Lai, W. Yun, P. Ilinski, D. Legnini, J. Maser, and W. Rodrigues, "A Hard X-ray Scanning Microscope for Fluorescence Imaging and Microdiffraction at the Advanced Photon Source", (2000) X-ray Microscopy: Proceedings of the Sixth International Conference, edited by W. Meyer-Ilse, T. Warwick, and D. Attwood.
50. R. Dejus, I. Vasserman, S. Sasaki, and E. Moog Undulator, "A Magnetic properties and Spectral Performance", (2002) Report ANL/APS/TB-45. Argonne National Laboratory, Argonne, Ill., USA.
51. J. Libera, Z. Cai, B. Lai, and S. Xu, "Integration of a Hard X-ray Microprobe with a Diffractometer for Microdiffraction", Review of Scientific Instruments 73(3) (2002), 1506-1508.
52. J. B. Nelson, D. P. Riley, "An experimental investigation of extrapolation methods in the derivation of accurate unit-cell dimensions of crystals", Proc. Phys. Soc. 57 (1945) 160-177.

The invention claimed is:

1. A high-entropy alloy (HEA) having a formula of $Fe_aNi_bMn_cAl_dCr_eC_f$ where a is 37-43 atomic %, b is 8-14 atomic %, c is 32-38 atomic %, d is 5-10.5 atomic %, e is 5-9 atomic % and f is 0-2 atomic %.

2. The HEA of claim 1, wherein f is between 0.5 and 1.1 atomic %.

3. The HEA of claim 1 having the formula $Fe_{40.42}Ni_{11.28}Mn_{34.78}Al_{7.52}Cr_6$, wherein the composition is expressed in terms of atomic percentages.

4. The HEA of claim 1 having the formula $Fe_{39.9}Ni_{10.4}Mn_{35.6}Al_{7.4}Cr_{5.6}C_{1.1}$, wherein the composition is expressed in terms of atomic percentages.

5. The HEA of claim 1, wherein the HEA has a face centered cubic structure.

6. The HEA of claim 1, wherein the HEA is a solid solution.

7. The HEA of claim 6, wherein the solid solution comprises interstitial carbon atoms.

8. The HEA of claim 1, wherein the HEA has a yield strength of at least 350 MPa at room temperature.

9. The HEA of claim 1, wherein the HEA has an ultimate tensile strength (UTS) of at least 1200 MPa at room temperature.

10. The HEA of claim 1, wherein the HEA has an elongation to failure of at least 50% at room temperature.

11. A composition comprising the high-entropy alloy of claim 1.

12. The composition of claim 11 further comprising one or more intermetallic carbide particles having a formula independently selected from the group consisting of $M_{23}C_6$ and $M_7C_3$, wherein M is independently selected from the group consisting of Fe, Ni, Mn, Al and Cr.

* * * * *